United States Patent [19]

Pruckner

[11] Patent Number: 4,559,650

[45] Date of Patent: Dec. 24, 1985

[54] STAINLESS STEEL TOILET

[75] Inventor: Walter Pruckner, Downsview, Canada

[73] Assignee: Waltec, Inc., Ontario, Canada

[21] Appl. No.: 550,129

[22] Filed: Nov. 9, 1983

[51] Int. Cl.[4] ..... E03D 11/08

[52] U.S. Cl. ..... 4/420; 4/DIG. 15

[58] Field of Search ..... 4/262, 263, 300, 311, 4/420, 237, 660, DIG. 15

[56] References Cited

U.S. PATENT DOCUMENTS

| | | | |
|---|---|---|---|
| 801,221 | 10/1905 | Cooper | 4/263 |
| 1,129,826 | 2/1915 | Cronk | 4/420 |
| 3,411,162 | 11/1968 | Palmer | 4/420 |
| 3,538,518 | 11/1970 | Helke et al. | 4/420 |
| 3,983,582 | 10/1976 | Morris et al. | 4/98 |
| 4,137,580 | 2/1979 | Iwans et al. | 4/420 |

FOREIGN PATENT DOCUMENTS

| | | | |
|---|---|---|---|
| 108017 | 8/1907 | Canada . | |
| 343457 | 7/1934 | Canada . | |
| 800203 | 12/1968 | Canada . | |
| 994501 | 8/1976 | Canada . | |
| 1089154 | 11/1980 | Canada . | |
| 9226 | of 1911 | United Kingdom | 4/420 |

*Primary Examiner*—Stephen Marcus
*Assistant Examiner*—Linda J. Sholl
*Attorney, Agent, or Firm*—Russell S. Smart; Vance Marston; Charles W. Fallow

[57] ABSTRACT

There is a requirement when using toilets to prevent and/or remove the accumulation of odor-causing substances from the sidewall of the toilet bowl. This can easily be accomplished with ceramic toilets where the water is directed to swirl around by angled holes formed in the flushing rim. However, in stainless steel toilets, the material is too thin to form angled holes and the water has previously simply entered a flushing rim and run vertically down the wall of the toilet. This invention is an improvement in the flushing rim portion of a stainless steel toilet which causes the water to swirl around as in ceramic toilets, to effectively clean the inside of the toilet bowl. Instead of drilled holes, the rim has upturned notches in its lower wall which cause the flushing water to spray the toilet bowl wall in an overlapping pattern. The notches also contribute to the swirling action of the water.

3 Claims, 4 Drawing Figures

STAINLESS STEEL TOILET

BACKGROUND OF THE INVENTION

This invention relates to an improvement in a flushing rim portion of a stainless steel toilet.

In flushing toilets, there is a requirement to prevent and/or remove the accumulation of odour-causing substances from the inside wall of the toilet bowl. One solution is to provide a means for washing the sidewall by means of a relatively high velocity concentrated sheet or stream of water. This is easily accomplished with ceramic toilets where the water is caused to swirl around the wall of the bowl by angled holes formed in the rim of the toilet bowl, which is about one half inch thick.

In stainless steel toilets, however, there is only about one sixteenth inch thickness, so that drilling holes at an angle would be totally ineffective.

In stainless steel toilets, the water has previously simply entered a flushing rim formed in an integral toilet seat and flushing rim combination. U.S. Pat. No. 3,983,582 issued on Oct. 5, 1976 to Acorn Engineering Company, discloses such a device. When the toilet is flushed, the water enters into the hollow seat-flushing rim from the side opposite the front of the seat-rim and fills both sides of the rim. At the same time, water is forced through openings between the sidewall and a serrated edge on the bottom portion of the seat-rim. These openings simply result in the water flowing vertically down the sidewall to wash it.

SUMMARY OF THE INVENTION

The present invention is an improvement on this arrangement and involves forming a number of up-turned notches on the outer edge of a flushing rim through which the water flows. A baffle causes the water to circulate around the flushing rim in one direction only and, when it encounters the up-turned notches, it is directed through openings in such a manner that the water swirls around the sidewalls in the toilet bowl. This arrangement provides a better cleaning action than the arrangement shown in U.S. Pat. No. 3,983,582.

More particularly according to the present invention there is provided an integral toilet seat and flushing rim combination for use in stainless steel toilets comprising an upper portion forming the toilet seat and a lower portion having an outer circumferential edge formed with a plurality of up-turned notched portions defining openings in said lower portion for the passage of water therethrough to a sidewall of a toilet bowl in a manner that produces an overlapping water spray pattern, said upper and lower portions being joined together and to said toilet bowl to form a hollow flushing rim, a baffle being situated in the hollow flushing rim at a water supply means in communication with the hollow flushing rim which ensures a uni-directional flow of water around the hollow flushing rim; whereby when the toilet is flushed, water is forced through the openings at an angle so that a swirling effect is produced; which combined with the overlapping spray pattern that is produced ensures that all sidewall areas of the toilet bowl are thoroughly cleaned.

The advantages and other features of the present invention will be more fully described with reference to the accompanying drawings.

DESCRIPTION OF THE PREFERRED EMBODIMENT

Figure 1:
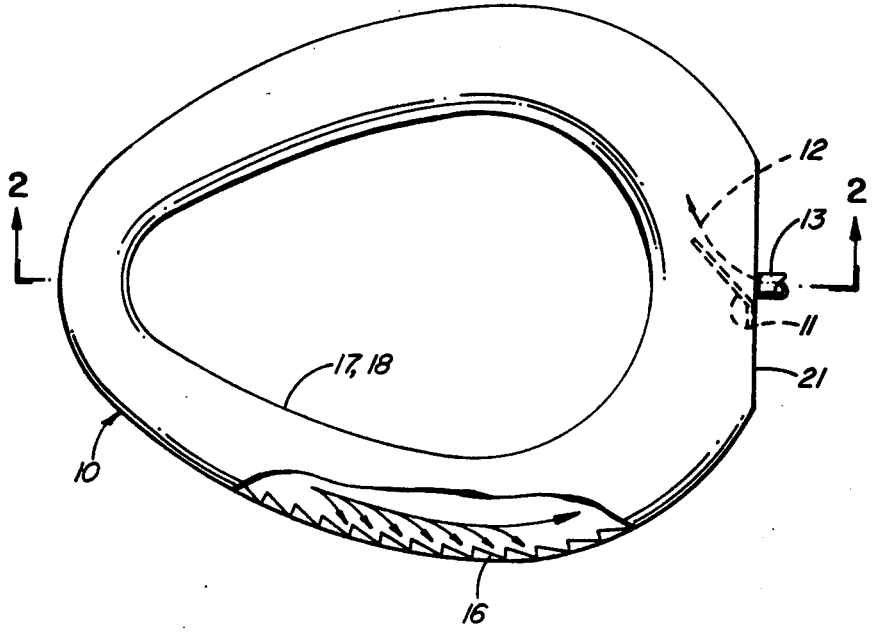
FIG. 1 is a top plan view of the flushing rim with a portion cut away to show the location of the notches on the outer edge of the flushing rim.

With reference to FIG. 1, a top view is shown of the integral toilet seat and rim combination 10, hereinafter sometimes referred to for simplicity as rim 10. A baffle 11 attached by suitable means, such as welding, to the sidewall 21 of rim 10, ensures that the flow of water is directed in one direction only. An arrow designated 12 indicates the direction of flow in this embodiment. When the toilet is flushed, the water enters through a tubular water entry duct 13.

Figure 2:
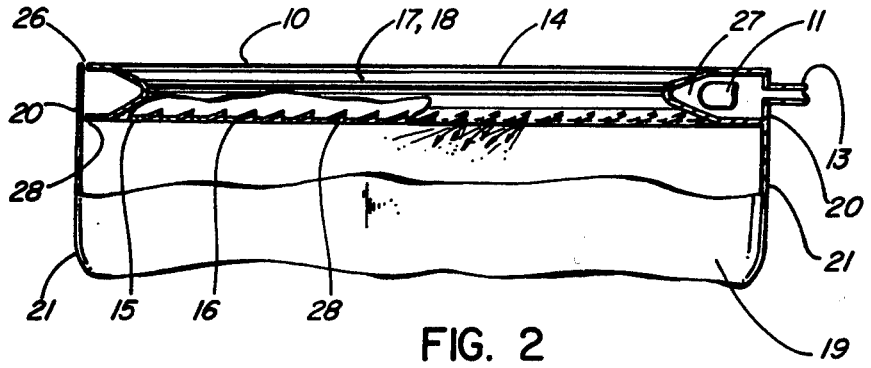
FIG. 2 is an elevational section view of the seat-rim combination taken along the line 2—2 of FIG. 1 showing the hollow flushing rim.

FIG. 2 is a cross-sectional view along line 2—2 of FIG. 1 of the toilet seat and rim combination 10. This seat and rim combination comprises an upper portion 14 (forming the seat) and a lower portion 15. The lower portion 15 is identical to the upper portion 14 except for a notched outer circumferential edge 16. The upper and lower portions 14 and 15 are aligned so that inner edges 17, 18 of the portions 14 and 15 contact each other. Once aligned, these edges 17, 18 are welded or brazed together thereby forming a unitary seat and rim combination 10.

As further shown in FIG. 2, an upper portion 20 of a sidewall 21 of a toilet bowl 19 is essentially vertical throughout a distance which is at least equal to that of the maximum thickness of the cross-sectional portion of the seat and rim 10.

The seat and rim combination 10 is then slidably inserted into the upper vertical portion 20 of the sidewall 21 of the toilet bowl 19 until the upper part of the rim is flush with the top of the sidewall 21. Following this, the outer edges 26, 28 of the portions 14 and 15 are brazed or welded to the sidewall 20 of the toilet bowl 19.

Figure 3:
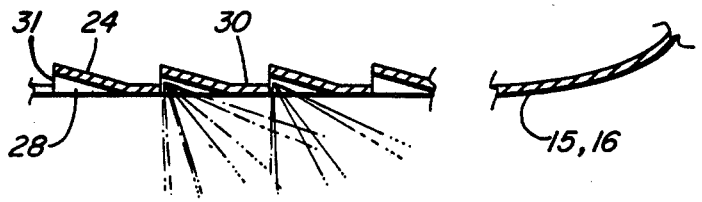
FIG. 3 is a more detailed side view of the notches in the flushing rim and shows the flushing action that results from a flushing rim in a stainless steel toilet as disclosed.
Figure 4:
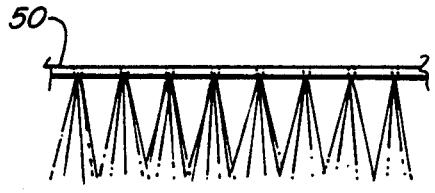
FIG. 4 ( PRIOR ART )
FIG. 4 is a schematic view of the flushing action that results from a conventional flushing rim in a stainless steel toilet.

When the toilet is flushed, water enters the tubular water entry duct 13 and flows into a hollow, annular flushing rim chamber 27 which is formed by the rim 10 in conjunction with the vertical section of the upper portion 20 of the toilet bowl sidewall 21. As the water enters the flushing rim chamber 27, it flows around the seat-rim 10 in one direction, in this case counterclockwise. Simultaneously, the water within the chamber 27, due to the swirling effect of the water flow in one direction and gravity, is forced into the toilet bowl 19 beneath the rim 15 via water exit passageways 28 formed by up-turned notched portions 29 around the outer periphery of lower portion 15, the notched portions being best shown in FIG. 3. The swirling water is caught by the upward turned portions 31 of the notches 29 and directed against the sidewall 21 of the toilet bowl 19 in an overlapping spray pattern (see FIG. 3). The combined effect of the unidirectional water flow caused by the baffle 12 and the up-turned notches 29 produces a swirling effect, which increases the velocity and the strength of the waterflow. This increased velocity of waterflow combined with the overlapping pattern that is produced ensures that little or no residue remains on sidewall 21 of the toilet bowl 19 after flushing. This is to be contrasted with the conventional flushing action of the arrangement of FIG. 4 which simply has holes 50 in the bottom of the rim.

The notches are shown as being triangular and are easily formed by a punching operation. They may be about ½ inch long and spaced about ¾ inch apart, although the dimensions are not critical. They may be bent up to give openings about 1/16 inch high by about ¼ inch wide.

I claim:

1. In a sheet metal toilet of the type including a bowl having a sidewall with a seat affixed thereto, said seat comprising interconnected upper and lower portions defining therebetween an annular space, the periphery of said lower space having apertures to allow escape therefrom of water introduced into said space during flushing of the toilet, the improvement comprising, in combination therewith, means for producing unidirectional peripheral water flow within said space, and an upwardly deformed leading edge at each aperture to intercept the peripherally flowing water and direct the same obliquely down the wall of the toilet bowl.

2. The invention of claim 1, wherein each of said apertures defines substantially a triangle bounded on one side by the sidewall of the bowl, the other two sides of each triangle being formed by a notch in the periphery of said lower seat portion.

3. The invention of claim 1, wherein said means for producing unidirectional water flow is a baffle angularly positioned before a water supply inlet to said annular space.

* * * * *

UNITED STATES PATENT AND TRADEMARK OFFICE

CERTIFICATE OF CORRECTION

PATENT NO. : 4,559,650

DATED : December 24, 1985

INVENTOR(S) : Prukner

It is certified that error appears in the above-identified patent and that said Letters Patent is hereby corrected as shown below:

Title page, Item [19] and [75] :

Inventor's name should read --Walter Prukner--.

Signed and Sealed this

*Eighth* Day of *April 1986*

[SEAL]

*Attest:*

DONALD J. QUIGG

*Attesting Officer*

*Commissioner of Patents and Trademarks*